United States Patent [19]

Raso

[11] Patent Number: 4,932,497

[45] Date of Patent: Jun. 12, 1990

[54] AUXILIARY TOWER CLIMBING STEP

[76] Inventor: Paul C. Raso, 34 Summit Ave., Tappan, N.Y. 10983

[21] Appl. No.: 347,461

[22] Filed: May 4, 1989

[51] Int. Cl.[5] ..... A63B 27/00; A63B 29/04

[52] U.S. Cl. ..... 182/92; 182/189; 248/231.7

[58] Field of Search ..... 182/92, 134, 100, 189; 248/231.7

[56] References Cited

U.S. PATENT DOCUMENTS

| | | | |
|---|---|---|---|
| Re. 25,341 | 3/1963 | Majewski | 248/231.7 |
| 1,312,399 | 8/1919 | Heywood | 182/134 |
| 2,957,538 | 10/1960 | Pottmeyer | 182/189 |
| 3,182,943 | 5/1965 | Crossman | 248/231.7 |
| 3,399,746 | 9/1968 | Wood | 182/100 |
| 3,902,931 | 9/1975 | Danciger | 248/231.7 |
| 4,775,030 | 10/1988 | Wright | 182/92 |

*Primary Examiner*—Reinaldo P. Machado
*Attorney, Agent, or Firm*—Brooks Haidt Haffner & Delahunty

[57] ABSTRACT

For assisting ascent of metal frame towers where steps are not provided, a U-shape adapter is provided for temporarily mounting a step bolt. The adapter has spaced apart legs for straddling the flange of a tower structural member. A tapped bore through one of the legs receives the threaded shank of the step bolt, and the assembly can then be secured to the tower flange like a C-clamp.

14 Claims, 1 Drawing Sheet

AUXILIARY TOWER CLIMBING STEP

BACKGROUND OF THE INVENTION

The present invention relates to steps for mounting metal frame towers, and, more particularly, to steps for climbing high tension or transmission towers and the like.

To enable field workers to reach the upper areas in power transmission towers, or the like, such towers are often provided with a series of steps of one form or another. In one type of construction a corner leg of the tower is drilled and tapped to receive a series of step bolts that are permanently installed. In some instances, however, the utilities refrain from installing the step bolts to impede access by unauthorized individuals. However, without the steps provided by the step bolts it is often difficult to reach certain areas of the tower due to its particular design and construction. In such instances workers have had to rely upon connecting safety lines periodically as they ascend the tower, all of which tends to render climbing the tower a difficult matter.

SUMMARY OF THE INVENTION

Therefore, it is an object of the present invention to provide a simple and reliable auxiliary step that can be installed temporarily by the field worker as he or she ascends the particular tower.

A further object of the invention is to provide an adaptor for use in removably securing a conventional step bolt to a flange of a structural member in a metal frame tower.

In accordance with the invention there is provided for removably securing a step bolt to a flange of a structural member in a metal frame tower, an adapter in the form of a U-shape structure having two parallel legs joined by a back member. The parallel legs are spaced apart a distance at least as great as the thickest dimension to be encountered in the flanges of the tower structural members with one of said legs having a through bore threaded over at least part of its length to receive therethrough the threaded end of a step bolt whose threaded length exceeds the length of said bore by an amount in excess of the difference between said distance and the thinnest structural flange to be encountered on said tower.

In accordance with a further aspect of the invention there is provided an auxiliary step for attachment to a structural member in a metal frame tower at non predrilled and tapped locations. The step comprises an adapter in the form of a U-shape structure having two parallel legs joined by a back member. The parallel legs are spaced apart a distance at least as great as the thickest dimension to be encountered in the flanges of the tower structural members with one of said legs having a through bore threaded over at least part of its length. A step bolt with a threaded end is threadedly inserted through said bore, the threaded length of said step bolt exceeding the length of said bore by an amount in excess of the difference between said distance and the thinnest structural flange to be encountered on said tower.

BRIEF DESCRIPTION OF THE DRAWINGS

The invention will be better understood after reading the following detailed description of the presently preferred embodiment thereof with reference to the appended drawings in which.

The same reference numerals are used throughout the figures of the drawings to designate the same or similar parts.

DETAILED DESCRIPTION OF THE PRESENTLY PREFERRED EMBODIMENT

Figure 1:
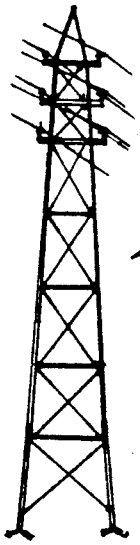
FIG. 1 is a diagrammatic illustration of an exemplary open frame tower for supporting transmission lines.

Referring to FIG. 1 there is illustrated a typical high tension transmission line tower of open metal frame construction. It is designated by the reference numeral 10 and it should be understood that the illustration is only illustrative and that the tower may take the form of any known configuration and structural arrangement. What is important is that it consists of an open framework having trusses and beams and the like provided with flanges to which the adapter to be described can be secured.

Figure 4:
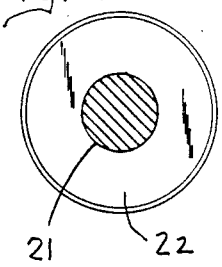
FIG. 4 is a transverse sectional view taken along line 4–4 in FIG. 2.
Figure 3:
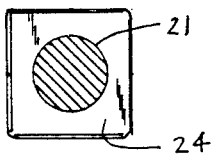
FIG. 3 is a transverse sectional view taken along line 3—3 in FIG. 2.
Figure 2:
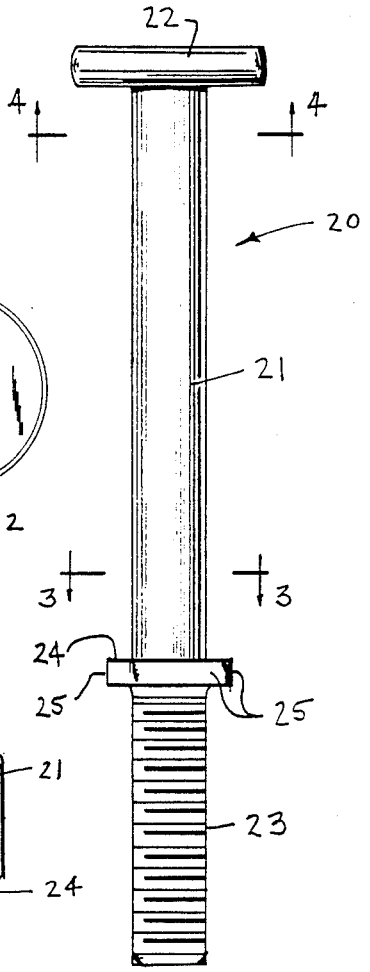
FIG. 2 is a plan view of a conventional step bolt.

FIGS. 2, 3, and 4 illustrate a conventional step bolt designated by the numeral 20 and consisting of a step portion 21 terminated at one end with a flanged head 22 and at the other end having a threaded shank 23 separated from the portion 21 by a flange 24 having square wrench-flat surfaces 25.

Figure 5:
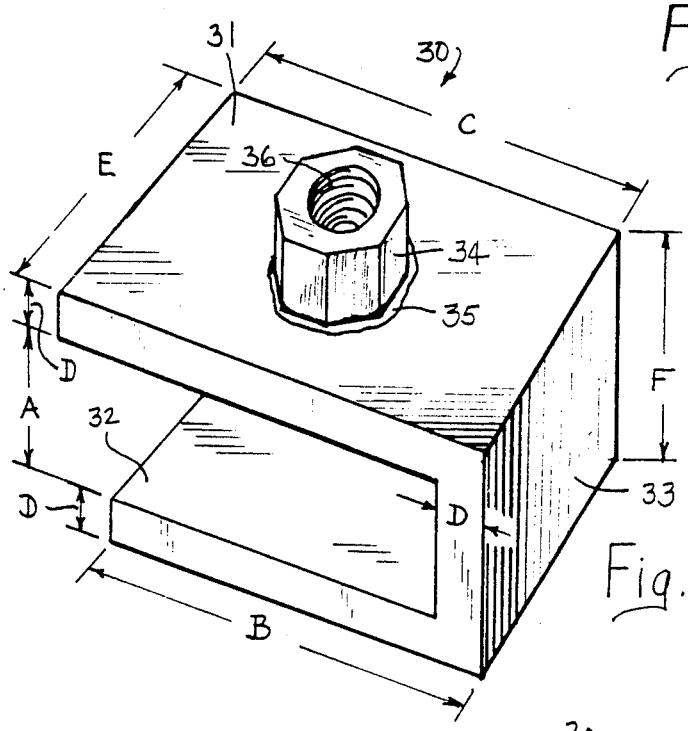
FIG. 5 is a perspective view of an adapter embodying the present invention.
Figure 6:
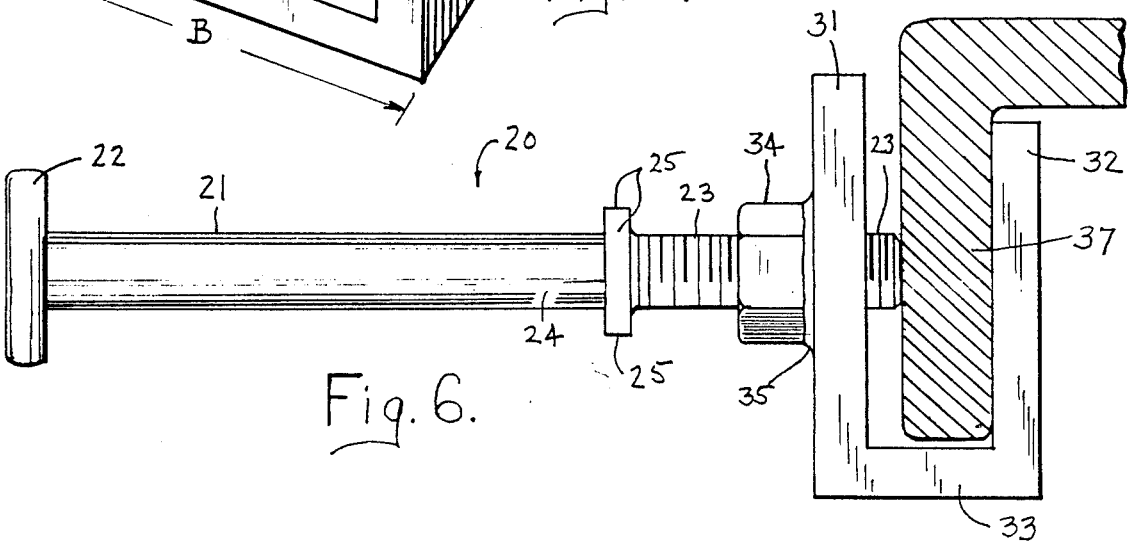
FIG. 6 is a plan view of the auxiliary step embodying the present invention illustrating its installation attached to a structural flange member shown in section.

FIG. 5, to which attention should now be directed, illustrates the adapter in the form of a U-shaped structure 30 having two parallel legs 31 and 32 joined by a back member 33. The parallel legs are spaced apart a distance A at least as great as the thickest dimension to be encountered in the flanges of the tower structural members. One of the legs, namely the leg 31, has a threaded nut 34 welded at 35 to its top surface. A cylindrical bore through the leg 31, not seen in the drawing, provides a continuation of the bore 36 of the nut to enable the threaded end 23 of the step bolt to penetrate through the leg 31 as best seen in FIG. 6. From FIG. 6 it should be apparent that the threaded length of the threaded end 23 of the step bolt should exceed the thickness of the leg 31 including the thickness of the nut 34, i.e. the combined length of the bore through leg 31 and the bore 36, by an amount in excess of the difference between the distance between legs 31 and 32 and the thinnest structural flange to be encountered on the tower. This is to ensure that the step bolt can be threaded through the nut 34 into clamping engagement against the tower member flange 37 as shown in FIG. 6.

In a working model of the subject adapter the following dimensions have been employed successfully: the distance or gap between legs 31 and 32, dimension A, was about $1\frac{1}{4}$ inches. The leg 32 was approximately $3\frac{3}{4}$ inches as measured on the outer surface, dimension B, while the leg 31 was $4\frac{1}{4}$ inches long, dimension C. The legs 31 and 32 as well as the back member 33 were each about $\frac{1}{2}$ inch thick, dimension D. The width of the U-shaped member, dimension E, was about $2\frac{1}{2}$ inches, while the nut 35 had the dimensions of a heavy duty $1\frac{1}{4}$ inch hex nut. Dimension F was about $2\frac{1}{4}$ inches. The step bolt had a standard $\frac{3}{4}$ inch threaded shaft with a square wrenching flange 24 measuring $1\frac{1}{4}$ inches. Under certain conditions of use, the width of the U-shaped member, dimension E, can be reduced to as little as $1\frac{1}{4}$ inches, the distance across the flats of the nut 34.

In use, a field worker with a supply of the auxiliary steps can mount the tower and install the steps wherever necessary removing the same during descent from the tower.

Having described the invention with reference to the presently preferred embodiment thereof it should be apparent that various changes in construction can be effected without departing from the true spirit of the invention as defined in the appended claims.

What is claimed is:

1. For removably securing a step bolt to a flange of a structural member in a metal frame tower, an adapter in the form of a U-shape structure having two parallel legs joined by a back member, said parallel legs being spaced apart a distance at least as great as the thickest dimension to be encountered in the flanges of the tower structural members, one of said legs having a through bore threaded over at least part of its length to receive therethrough the threaded end of a step bolt whose threaded length exceeds the length of said bore by an amount in excess of the difference between said distance and the thinnest structural flange to be encountered on said tower, said U-shape structure being further dimensioned and constructed to secure said step bolt to any of said tower structural members for providing a tower worker with a step.

2. An adapter according to claim 1, wherein the transverse dimension of said U-shape structure is at least about $1\frac{1}{4}$ inches.

3. An adapter according to claim 2, wherein said legs and back member of said U-shape structure are each about $\frac{1}{2}$ inch thick.

4. An adapter according to claim 3, wherein said distance between said parallel legs is about $1\frac{1}{4}$ inches.

5. An adapter according to claim 4, wherein said one leg is about $\frac{1}{2}$ inch longer than the other of said legs.

6. An adapter according to claim 5, wherein the length of said one leg measured inside the U-shape structure from said back member is about $3\frac{3}{4}$ inches.

7. An adapter according to claim 1, wherein the length of said one leg measured inside the U-shape structure from said back member is about $3\frac{3}{4}$ inches.

8. An adapter according to claim 7, wherein the transverse dimension of said U-shape structure is at least about $1\frac{1}{4}$ inches.

9. An adapter according to claim 8, wherein said one leg is about $\frac{1}{2}$ inch longer than the other of said legs.

10. An adapter according to claim 9, wherein said distance between said parallel legs is about $1\frac{1}{4}$ inches.

11. An adapter according to claim 10, wherein said legs and back member of said U-shape structure are each about $\frac{1}{2}$ inch thick.

12. An adapter according to claim 1, wherein said distance between said parallel legs is about $1\frac{1}{4}$ inches.

13. An adapter according to claim 12, wherein said one leg is about $\frac{1}{2}$ inch longer than the other of said legs.

14. An auxiliary step for attachment to a structural member in a metal frame tower at non pre-drilled and tapped locations, said step comprising an adapter in the form of a U-shape structure having two parallel legs joined by a back member, said parallel legs being spaced apart a distance at least as great as the thickest dimension to be encountered in the flanges of the tower structural members, one of said legs having a through bore threaded over at least part of its length, and a step bolt with a threaded end threadedly inserted through said bore, the threaded length of said step bolt exceeding the length of said bore by an amount in excess of the difference between said distance and the thinnest structural flange to be encountered on said tower.

* * * * *